United States Patent [19]

Fleckenstein

[11] Patent Number: 5,056,393

[45] Date of Patent: Oct. 15, 1991

[54] REVERSIBLE FILM CUTTER ASSEMBLY

[75] Inventor: Allen E. Fleckenstein, Bellevue, Wash.

[73] Assignee: Ciba-Geigy Corporation, Ardsley, N.Y.

[21] Appl. No.: 496,275

[22] Filed: Mar. 20, 1990

[51] Int. Cl.[5] ..... B65H 21/00

[52] U.S. Cl. ..... 83/365; 83/369; 83/370

[58] Field of Search ..... 83/365, 369, 370; 352/129, 136; 355/29; 53/520; 242/201, 202, 56.6; 271/220

[56] References Cited

U.S. PATENT DOCUMENTS 3,167,265 1/1965 Thau ..... 242/202

4,280,381 7/1981 Willenberg et al. ..... 83/365

*Primary Examiner*—Mark Rosenbaum

*Assistant Examiner*—Allan M. Schrock

*Attorney, Agent, or Firm*—Christensen, O'Connor Johnson & Kindness

[57] ABSTRACT

A film cutter assembly reversible between a right-to-left and a left-to-right film feed configuration. The film cutter assembly (10) includes a housing (16), an upper control panel (48), a lower control panel (60), and a reel assembly (14). The housing includes a first end panel (20), a second end panel (24), a base (17), and a film track (26). Each control panel is selectively mountable to the housing on either side of the film track, so that the upper control panel is located above the film track regardless of whether the film cutter assembly is in its right-to-left configuration, resting on a first pair of resting edges (28 and 38), or in its left-to-right configuration, resting on a second pair of resting edges (30 and 40). The reel assembly is selectively mountable to the first end panel, so that the reel assembly is vertically oriented regardless of which configuration the film cutter assembly is in. The operating components of the reel assembly are reversibly mountable to a mounting plate (100), so that the reel assembly is operable in either configuration.

8 Claims, 4 Drawing Sheets

REVERSIBLE FILM CUTTER ASSEMBLY

TECHNICAL FIELD

This invention relates to photographic film cutting equipment and, more specifically, to a film cutter assembly that is easily reversible between a right-to-left and a left-to-right film feed configuration.

BACKGROUND OF THE INVENTION

In the commercial processing of photographic film, a large number of order finishing stations are normally employed in a single commercial setting. Each order finishing station has several components and includes a print cutter and print tray for cutting and collecting, respectively, photographic prints from a continuous reel of prints. Also, a film cutter accepts a continuous reel of developed negatives (more commonly known as film in the industry) and cuts the film into strips, usually four frames long. The cut strips of film exiting the film cutter are collected in a film tray, and the strips constituting one order are collected together and placed into one compartment of a small envelope called a wallet. The cut prints constituting one order are placed in a separate compartment of the wallet, which is then placed into a second, larger envelope that has customer identification on it. Using information compiled at the order finishing station as to the number of prints and type of film, the order can be priced and returned to the proper customer.

For a variety of reasons, none of which is directly relevant to the present invention, most order finishing stations utilize a film cutter of left-to-right film feed configuration. Specifically, the developed, or processed, film enters the film cutter from a continuous reel positioned to the left of the film cutter and exits in cut form at the right side of the film cutter (when facing the operating surface of the film cutter). Nonetheless, there are a significant number of order finishing stations in which the film flow is right to left. Both types of film cutters are often present in the same commercial processing laboratory. Additionally, utilizing ergonomic principles it has been discovered that using a film cutter of right-to-left film feed configuration, that is located at a position toward the operator from the print cutter, allows the lengthwise dimension of the order finishing station to be reduced by nearly two feet. This has the effect of allowing more order finishing stations in the same amount of area in commercial processing laboratories.

As a result, there has been a long-felt need for a film cutter that may be operated in either a right-to-left or left-to-right film feed mode using a common set of parts, thereby allowing a single film cutter assembly to be used in both types of existing order finishing stations and in newly designed order finishing stations of diminished length. By providing a single assembly that fits all laboratory configurations, a reduction in the inventory that must be stocked is achieved.

SUMMARY OF THE INVENTION

In accordance with this invention, a film cutter assembly that is reversible between a right-to-left and a left-to-right film feed configuration is disclosed. The film cutter assembly includes a housing, first and second control panels, and a reel assembly.

The housing includes multi-edged first and second end panels, a base, and a film track. Each end panel has adjacent first and second resting edges and a film track edge not adjacent the resting edges. The base has contiguous first and second base plates that share a longitudinal edge and are orthogonally coupled at each end to the end panels at a location adjacent the resting edges. The film track is coupled at its ends to the end panels at a location adjacent the film track edges.

First and second control panels are coupled at each end to the end panels of the housing at locations between the film track and the base plates on opposite sides of the film track. Each control panel is selectively mountable to the housing adjacent either side of the film track, so that the first control panel is located above the film track and the second control panel is located below the film track regardless of which resting edges the housing rests on.

The reel assembly is selectively mountable to the first end panel of the housing, so that the reel assembly is vertically oriented regardless of which resting edges the housing rests on.

BRIEF DESCRIPTION OF THE DRAWINGS

The foregoing and other features and advantages of the present invention will become more readily appreciated as the same becomes better understood by reference to the following detailed description of the preferred embodiment of the invention when taken in conjunction with the accompanying drawings, wherein.

DETAILED DESCRIPTION OF THE PREFERRED EMBODIMENT

Figure 1:
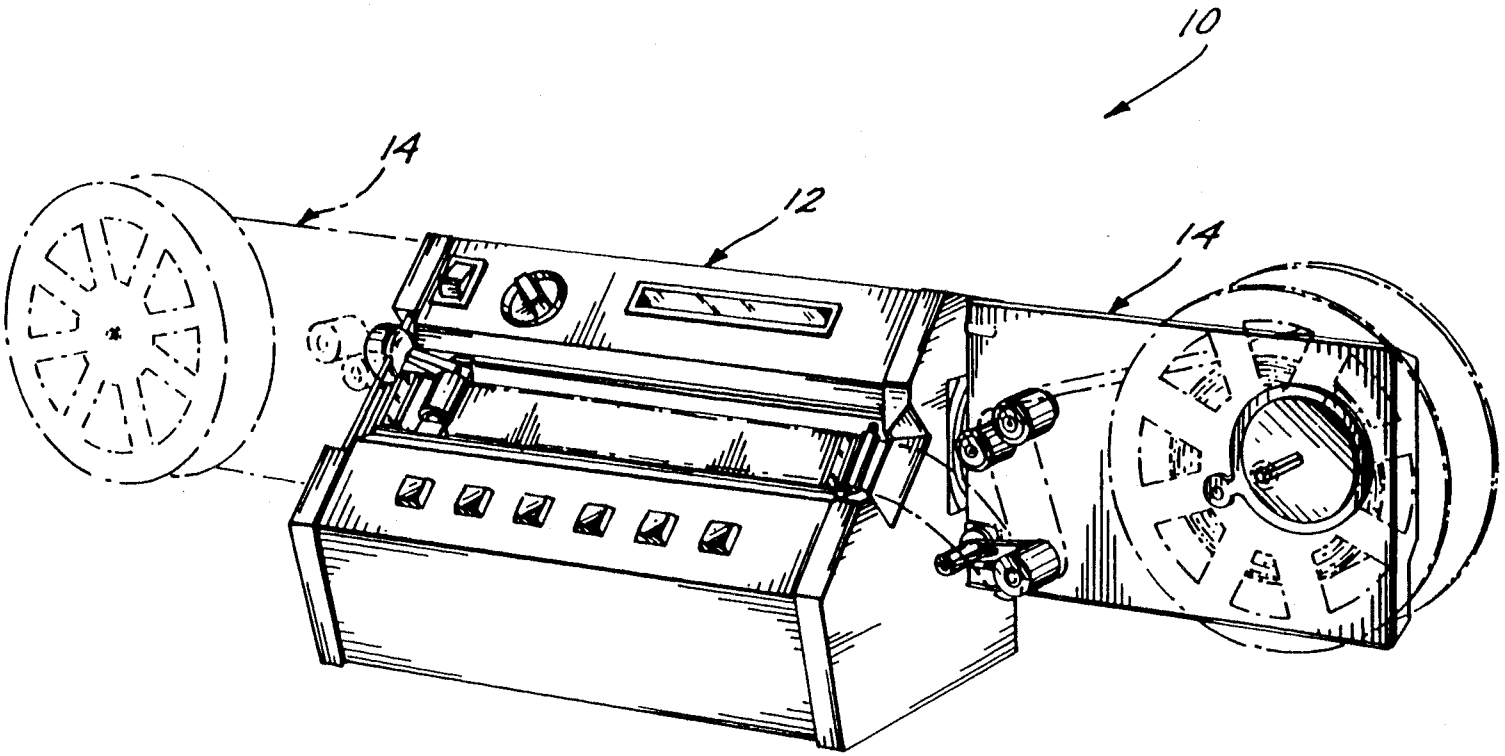
FIG. 1 is a perspective view of a reversible film cutter assembly made in accordance with the present invention, showing its right-to-left film feed configuration in solid line and its left-to-right film feed configuration in phantom line.

As illustrated in FIG. 1, a film cutter assembly 10 formed in accordance with the present invention is reversible between a right-to-left film feed configuration (shown in solid line) and a left-to-right film feed configuration (shown in phantom line). The film cutter assembly 10 is but one of the components that make up a photographic order finishing station (not shown).

FIGS. 1, 2, 3A, and 3B illustrate an embodiment of the film cutter assembly 10, generally including a film cutting unit 12 and a reel assembly 14. As will be more fully described below, certain components of the film cutting unit 12 and the reel assembly 14 are selectively mountable in order to provide a film cutter assembly 10 of alternative configuration.

Figure 2:
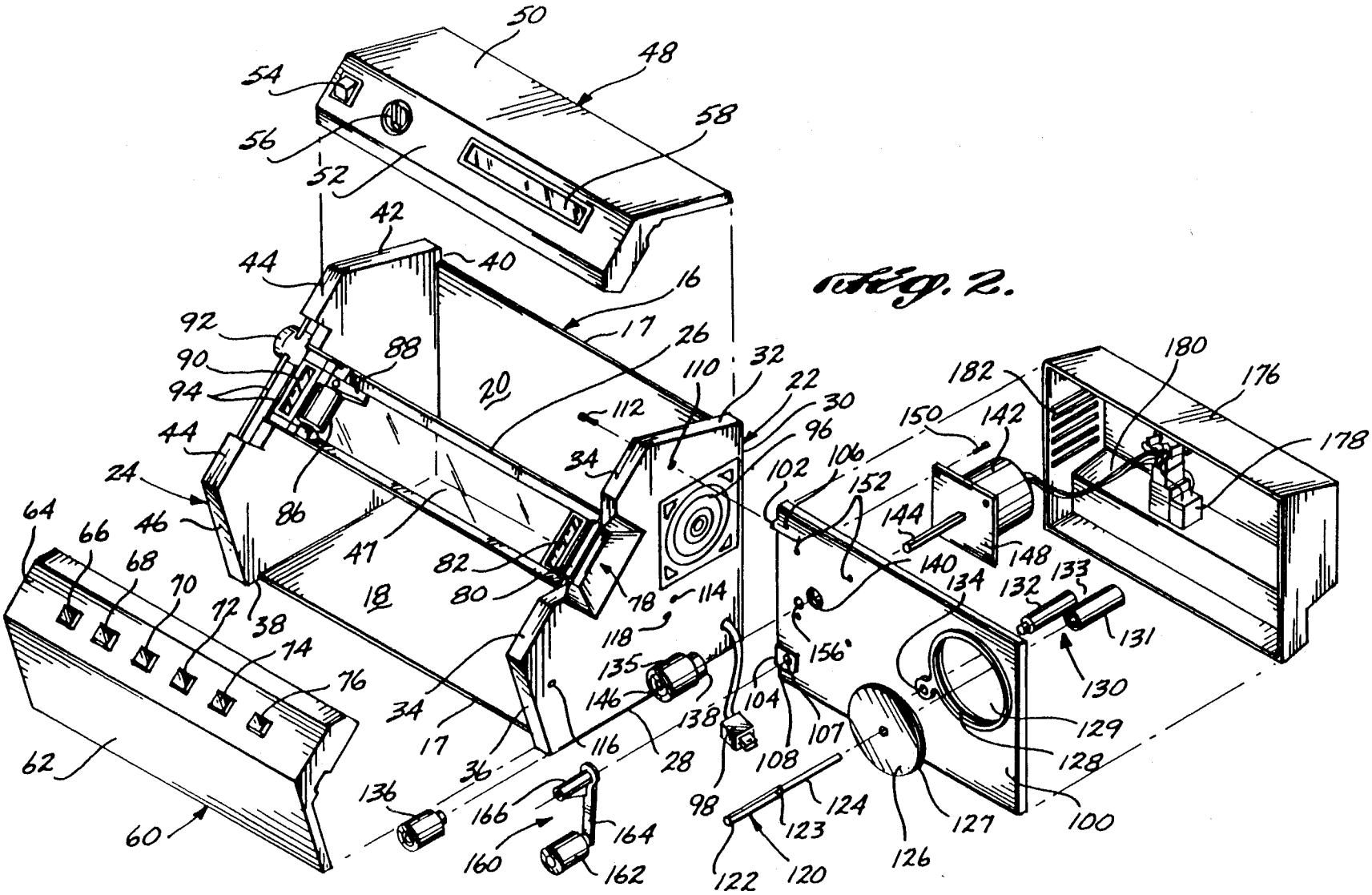
FIG. 2 is an exploded view of the reversible film cutter assembly shown in FIG. 1.

Referring more particularly to FIG. 2, the film cutting unit 12 includes a housing 16 having a base 17. The base 17 has a first base plate 18 and a contiguous second base plate 20, the base plates sharing a longitudinal edge and being oriented substantially at right angles to one another. Housing 16 also includes a first end panel 22, a second end panel 24, and a film track 26. End panel 22 and end panel 24 are of substantially similar five-edged configuration, illustrated as edges 28, 30, 32, 34, and 36 for end panel 22 and as edges 38, 40, 42, 44, and 46 for end panel 24, and are of substantially uniform thickness. End panels 22 and 24 are coupled generally orthogonally to the base 17 at each end of base plates 18 and 20 by conventional methods. Edges 28 and 38 form first resting edges having a length substantially matching the widthwise dimension of base plate 18, and edges 30 and 40 form second resting edges having a length substantially matching the widthwise dimension of base plate 20. Preferably, the base plates 18 and 20 are coupled just inside, rather than flush with, the resting edges of end panels 22 and 24. Thus, it is the resting edges that contact the surface upon which the cutting unit 12 is setting.

The film track 26 is coupled generally orthogonally at each end at the approximate midsection of the film track edges 34 and 44 of end panels 22 and 24, respectively. The film track 26 functions as a support surface over which the developed film passes during the operation of the film cutter assembly 10. Preferably, the film track has an integral back-lit surface 47 that is composed of a translucent material (e.g., white translucent plexiglass) which allows the frames of film to be viewed when an internally located fluorescent light source (not shown) is employed.

Figure 3A:
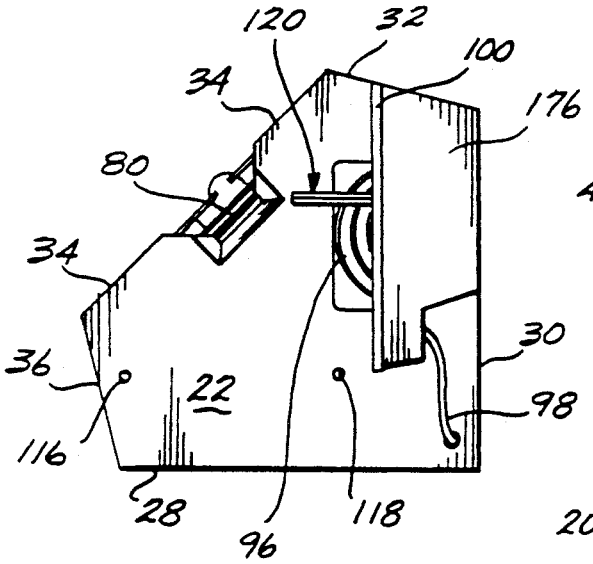
FIGS. 3A and 3B are end views of the reversible film cutter assembly, when in its right-to-left configuration.
Figure 3B:
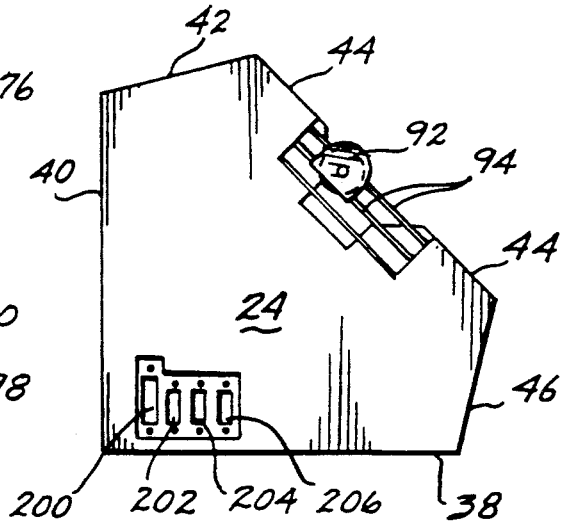

As best seen in FIGS. 3A and 3B, the film track edges of the end panels are substantially perpendicular to a line bisecting the angle formed between the resting edges of the end panels. Thus, film track edge 34 of end panel 22 is substantially perpendicular to a line bisecting the ninety-degree included angle formed between resting edges 28 and 30 of end panel 22. Similarly, film track edge 44 of end panel 24 is substantially perpendicular to a line bisecting the ninety-degree included angle formed between resting edges 38 and 40 of end panel 24. As a result, an operating surface containing machine function switches (described below) is created that lies in a plane defined by film track edges 34 and 44. The operating surface is oriented at forty-five degrees to the bottom surface of the film cutter assembly 10, regardless of whether the film cutter assembly is resting on resting edges 28 and 38, or on resting edges 30 and 40.

An upper control panel 48 is detachably mountable at its ends to end panels 22 and 24, on either side of the film track 26. When the film cutter assembly 10 is in its right-to-left film feed configuration, the control panel 48 has a support surface 50 having a widthwise dimension substantially matching the length of edges 32 and 42. The control panel 48 also has an operating surface 52 having a widthwise dimension substantially matching the length of the portion of film track edges 34 and 44 located above the film track 26. Along the operating surface 52 are located a power switch 54, a rotary select switch 56, and a machine status display 58. The rotary select switch 56 allows the film cutter assembly 10 to operate in varying modes to accommodate film of different types and, thereby, of different widths (e.g., 110, 126, and 135 film). The machine status display 58 shows the current mode selected by rotary select switch 56, and may display information such as error messages and the like.

A lower control panel 60, having substantially identical dimensions as control panel 48, is detachably mountable at its ends to end panels 22 and 24, on either side of the film track 26. When the film cutter assembly 10 is in its right-to-left film feed configuration, the control panel 60 has a support surface 62 having a widthwise dimension substantially matching the length of edges 36 and 46. The control panel 60 also has an operating surface 64 having a widthwise dimension substantially matching the length of the portion of film track edges 34 and 44 located below the film track 26. Along the operating surface 64 are located a series of control switches 66, 68, 70, 72, 74, and 76. While the ordering, and even the function, of these switches may vary as a matter or design choice, they could correspond to the following: a Runout switch for advancing the leader section of a new reel of film; a Jog Forward switch for incrementally advancing the film; a Jog Reverse switch for incrementally reversing the film; a Start switch for returning the film cutter assembly 10 to its normal, automatic, computer-controlled operation; a Cut switch causing the film to be cut at its present position; and a Stop switch for removing the film cutter assembly 10 from its normal, automatic, computer-controlled operation, respectively. The film cutting mechanism and the film advancing mechanisms of the film cutter assembly 10 of the present invention will be more fully described below.

A beveled film entry port 78 is formed in end panel 22 to receive the processed film from the reel assembly 14. The film, which is advanced across the film cutting unit 12 in a manner described immediately below, first encounters an entry guide roller 80 rotatably mounted to the film track 26. A sensor block 82 is mounted to the film track 26 at a point adjacent and immediately inside the entry guide roller 80. The film next passes over the back-lit surface 47, through which light is shined from an internally located fluorescent light source, to assist the operator of the film cutter assembly 10 in identifying and distinguishing the frames of film. At the film-exiting terminus of the back-lit surface 47, a drive roller 86 is drivingly mounted to the film track 26 to provide the force necessary to advance the film. Drive roller 86 may be driven by an internally located drive source (not shown), such as a DC stepper motor. An engagement lever 88 is coupled to the drive roller 86 such that movement of the engagement lever causes the drive roller to move into and out of engagement with the film. Both drive roller 86 and entry guide roller 80 are formed of a material that will not damage the surface of the developed film. The film next encounters a sensor block 90 fixedly mounted to the end of the film track 26 terminating at end panel 24. Sensor blocks 90 and 82 ensure that the film is stopped in the correct position before being cut when the film cutter assembly 10 is being operated in its normal, automatic, computer-controlled mode.

A reciprocating knife 92 having a freely rotating circular blade is integrally mounted to end panel 24, so that the reciprocating knife may cut the processed film by movement across the film in either direction. To allow for movement of the reciprocating knife 92, a recess of sufficient depth is formed in film track edge 44 of end panel 24. The reciprocating knife 92 travels along a pair of circular guide bars 94 mounted to each lengthwise terminus of the recess. While not shown, movement of the reciprocating knife 92 may be accomplished by movement of a cable attached to each of its sides. Movement of the cable (and thereby the reciprocating knife) may be accomplished automatically by the internally located computerized components of the film cutter assembly 10, or manually through the operation of control switch 74. After the film has been cut by reciprocating knife 92, and has been pushed beyond the outside boundary of end panel 24, the cut film is received within a film tray (not shown). When a complete individual order of cut film is collected in the film tray, the order finishing station operator retrieves it and places it within a wallet which makes up part of the total order returned to the customer.

An opening is formed in end panel 22 that is sized to accommodate a fan screen 96 mounted therein. The fan screen 96 is designed to allow the free movement of air toward and away from an internally located fan (not shown), but to restrict the inward movement of objects that could damage the fan. Another opening is formed in end panel 22 through which a reel assembly power cable 98 extends. The reel assembly power cable 98 is coupleable to the reel assembly 14, in a manner described below, to provide power and to control the function of the reel assembly.

As best illustrated in FIG. 3B, a recessed area is formed in end panel 24, with four openings located in the recessed area that extend through the end panel to accommodate a series of interface ports 200, 202, 204, and 206. While the ordering, and even the function, of these interface ports may vary as a matter of design choice, they could correspond to the following: a Print Cutter interface; an Order Finishing Station Computer interface; a Film Tray interface; and a Bar Code Reader interface, respectively.

As will be appreciated, no internal components necessary to power and control the film cutting unit 12 have been shown. This is because such components, and the circuitry and wiring connecting them, are well known in the art.

The reel assembly 14 includes a rectangular mounting plate 100 that is selectively end-mountable to end panel 22 at two locations, the dual mounting locations allowing the reel assembly 14 to be vertically oriented regardless of which set of resting edges the film cutter assembly 10 is resting on. A pair of threaded bores 102 and 104 are formed in one end of mounting plate 100 for purposes of attaching the mounting plate to end panel 22. Because of the relative thinness of mounting plate 100, a cylindrical raised boss 106 surrounds threaded bore 102 to provide a more secure point of attachment. Similarly, a raised boss 108 surrounds threaded bore 104. However, raised boss 108 has a substantially rectangular shape and a flat outer surface on either side of mounting plate 100 in order to provide the support necessary for threaded bore 104 and to provide a point of attachment for a reel assembly component to be described below.

When the film cutter assembly 10 is in its right-to-left film feed configuration, threaded bore 102 is aligned with a threaded hole 110 extending through end panel 22 and receives a screw 112 passing from a position internal to end panel 22 through threaded hole 110. Threaded bore 104 is aligned with a threaded hole 114 extending through end panel 22 and receives a similar screw (not shown) in a similar manner. When the film cutter assembly 10 is in its left-to-right film feed configuration, threaded bores 102 and 104 are aligned with a pair of threaded holes 116 and 118, respectively, extending through end panel 22 and receive the same pair of screws passing from a position internal to end panel 22.

A reel spindle 120 for supporting a reel of processed photographic film is reversibly mountable to the mounting plate 100 at a location distal from its end of attachment to end panel 22. The reel spindle 120 has a first end 122 of square cross section designed to accommodate the center attachment piece of the reel of film. A spring-loaded spherical detent 123 is disposed within the first end 122 of the reel spindle to hold the reel securely in place. The reel spindle 120 also has a second end 124 of circular cross section that extends through a circular aperture in a circular friction disk 126. Friction disk 126 has an enlarged portion 127 extending about its circumference that mates with a recessed groove 128 formed in the circumference of a circular opening 129 extending through mounting plate 100. The enlarged portion 127 of friction disk 126 is of a size and is composed of a material that supplies enough friction between it and the recessed groove 128 of opening 129 to prevent the film on the reel from inadvertent unravelling, but not enough friction to prevent the reel from turning under the force of the film advancing mechanisms of the film cutter assembly 10. Disposed on the opposite side of mounting plate 100 from the first end 122 of the reel spindle 120 is a reel spindle spacer mounting 130, the mounting having a first bearing assembly 131, a second bearing assembly 132, and a spacer plate 133 connecting the two bearing assemblies. Bearing assembly 131 is designed to receive, contain, and allow the free rotation of the circular second end 124 of the reel spindle. Bearing assembly 132 has a reduced threaded portion that meshes with a threaded mounting hole 134 formed in the mounting plate 100 near the periphery of opening 129, thereby holding the entire reel spindle spacer mounting 130 and the reel spindle 120 firmly in place.

The processed film is moved off the reel and toward the film cutting unit 12 through the operation of a drive roller 135 and a pinch roller 136 disposed near the end of mounting plate 100 attached to end panel 22. The drive roller 135 is of a cylindrical design, and has a reduced portion 138 that is disposed adjacent a circular opening 140 formed in mounting plate 100 when the drive roller is in its assembled position. On the opposite side of mounting plate 100 from drive roller 135 is located a drive unit 142 (e.g., an AC motor), the drive unit having a rotating shaft 144 that extends through opening 140 and is received within a circular bore 146 formed in the drive roller. A set screw extending through reduced portion 138 holds the drive roller 135 in place on shaft 144. The drive unit 142 has a flat mounting base 148 through which a plurality of screws 150 (single screw shown in FIG. 2) extend to engage a corresponding plurality of threaded holes 152 formed in mounting plate 100.

The pinch roller 136 is also of cylindrical design, and is held in place by a mounting (not shown) secured to a threaded circular opening 156 formed in mounting plate 100. Pinch roller 136 is mounted at a location that provides pressure between it and drive roller 135 necessary to forward the processed photographic film. Drive roller 135 and pinch roller 136 may be composed of an elastomeric material that allows the film to be forwarded without damaging the surface of the film, and also prevents film slippage.

A film loop sensor 160 is mounted to mounting plate 100 to create a loop of film between the drive roller 135 and the entry guide roller 80 on film cutting unit 12, thereby ensuring that the film enters the cutting unit in a nontensioned state. The film loop sensor 160 has a roller 162, over which the film passes, rotatably mounted to an arm 164 that extends orthogonally away from a central circular base portion 166. Base portion 166 is held in place by a mounting (not shown) secured to a threaded circular opening 170 formed in raised boss 108 of mounting plate 100. Referring to FIG. 1, it will be appreciated that as drive roller 86 advances a sufficient amount of film, the loop of film formed around film loop sensor 160 begins to diminish. As it does, roller 162 is lifted by the film, which causes the roller 162 and arm 164 to rotate upwardly about base portion 166 from their downward resting position. A sensor (not shown) detects this rotation and causes the drive roller 135 to advance film until the loop of film is sufficient to allow the roller and arm to return to their downward resting positions. Thus, the supply of film via drive roller 135 keeps pace with the prime movement of film via drive roller 86.

While the reel spindle 120, drive roller 135, pinch roller 136, and film loop sensor 160 project outwardly from a working surface of mounting plate 100, the components on the other side of the mounting plate are covered by a protective cover 176. The protective cover 176 has a connection port 178 designed to be engaged by reel assembly power cable 98. This interconnection allows the processing components located internally within film cutting unit 12 to govern the operation of drive roller 135, thereby governing the advancement of film from the reel. Input to drive unit 142, and thereby to drive roller 135, is transmitted from connection port 178 through a series of wires 180.

A vent 182 is located in the end of protective cover 176 adjacent end panel 22 to allow the fan located within film cutting unit 12 to properly vent. As shown in FIG. 2, the fan screen 96 is substantially blocked by the protective cover 176 of the reel assembly 14 when the film cutter assembly 10 is in its right-to-left film feed configuration. However, because the interconnection between mounting plate 100 and protective cover 176 is not air tight, sufficient venting is still provided. When the film cutter assembly 10 is in its left-to-right film feed configuration, fan screen 96 is unblocked.

The process of converting the film cutter assembly 10 of the present invention from its right-to-left film feed configuration to its left-to-right film feed configuration is best illustrated in FIGS. 4A through 4D. First, the film cutter assembly 10 is inverted to the position shown in FIG. 4B. As a result of this inversion, the film cutter assembly 10 now rests on resting edges 30 and 40, rather than on resting edges 28 and 38. It will be noted that the reel assembly 14 is in an inoperable position, and that the control panels 48 and 60 are upside down, after the inversion.

Figure 4C:
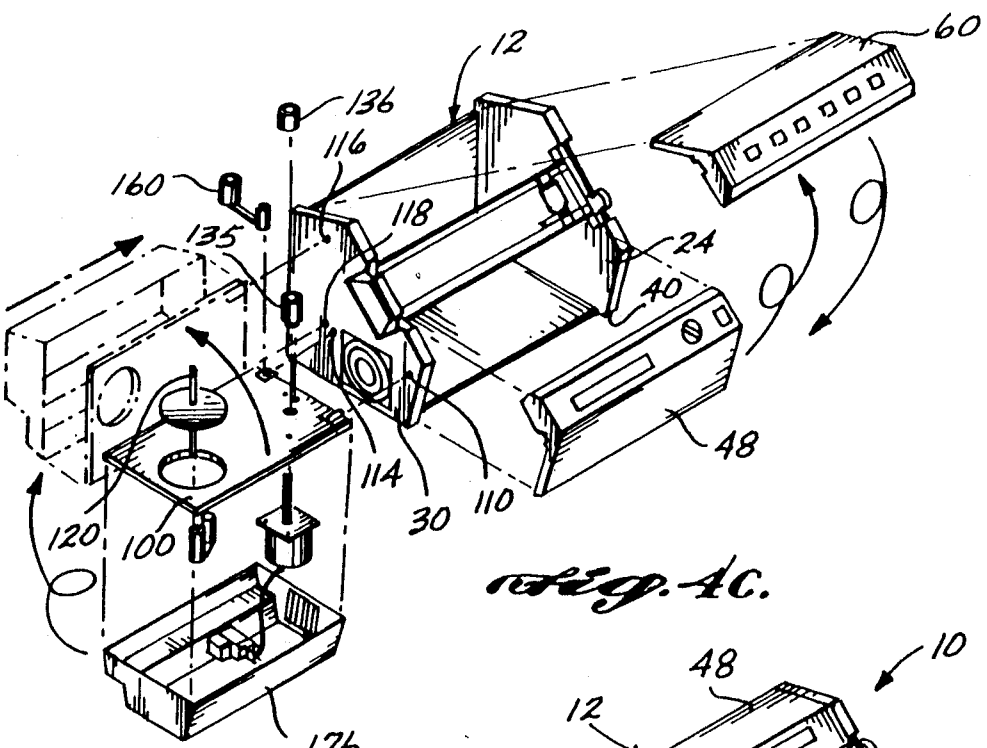
FIGS. 4A through 4D are isometric views illustrating the process of converting the reversible film cutter assembly of the present invention from its right-to-left configuration to its left-to-right configuration.

Referring to FIG. 4C, the control panels 48 and 60 are then detached, which provides the access required to detach the reel assembly 14 from end panel 22. The protective cover 176, reel spindle 120, drive roller 135, pinch roller 136, and film loop sensor 160 (along with their counterpart pieces) are detached from mounting plate 100 and remounted to the opposite side of the mounting plate. As described in the paragraphs above, it is the design of these components and the design of the mounting plate 100 itself that allows mounting in either direction. The reconfigured reel assembly 14 is rotated ninety degrees from the position shown in FIG. 4B, so that the threaded bore 102 of mounting plate 100 is aligned with threaded hole 116, and threaded bore 104 is aligned with threaded hole 118. After being secured in place by a pair of screws, the reel assembly 14 is now oriented in a vertical and operable position.

Figure 4D:
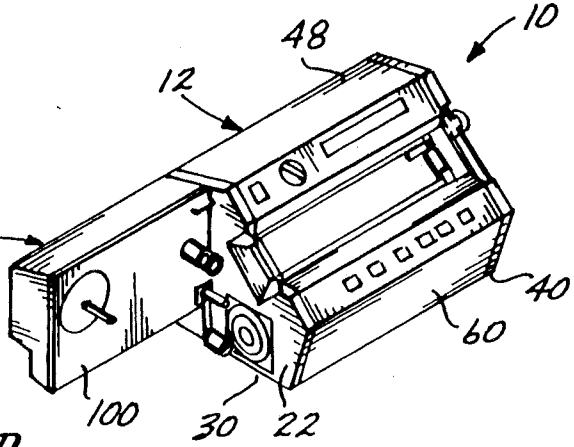
Figure 4A:
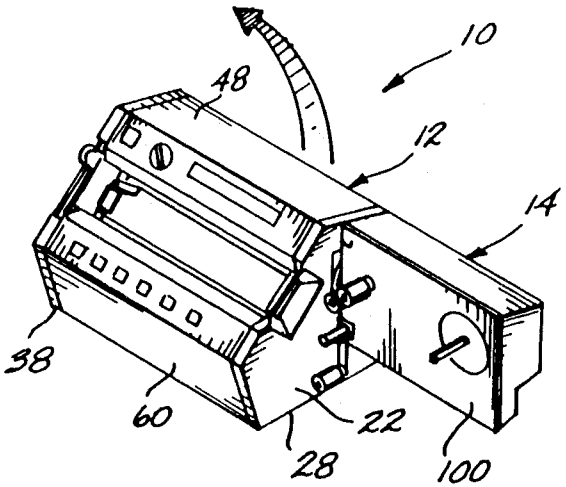
Figure 4B:
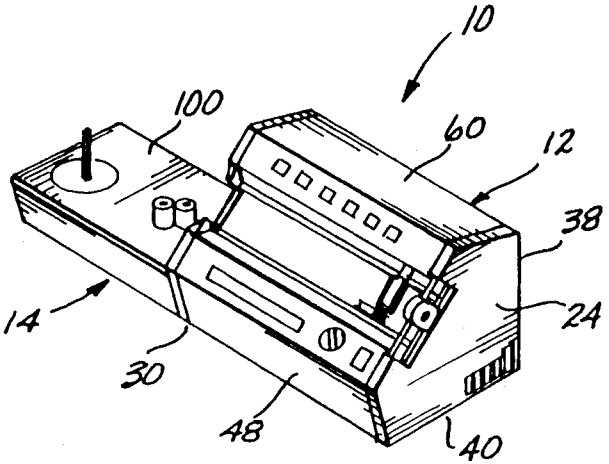

The control panels 48 and 60 are then reversed in position and reattached to film cutting unit 12, thereby forming the reconfigured film cutter assembly of left-to-right film feed direction shown in FIG. 4D. In order for the control panels 48 and 60 to be reversed in this manner, the interconnection between the lead from the internally located components of film cutting unit 12 and the control panel should be designed for quick coupling and uncoupling. Additionally, the lead should be of sufficient length to reach the control panel in both potential mounted positions.

Of course, it will be appreciated that the steps required to convert the film cutter assembly 10 from a right-to-left configuration to a left-to-right configuration need not be followed in the exact manner described above. For example, the reel assembly 14 could be detached before inverting the film cutting unit 12. It will also be appreciated that the film cutter assembly 10 of the present invention may also be converted from a left-to-right film feed configuration to a right-to-left film feed configuration. This process would be similar to, but generally in the reverse order of, the conversion process described immediately above.

Given that the film cutter assembly 10 of the present invention may be easily converted between these two configurations, a versatile film cutter is provided for commercial processing operations having existing order finishing stations utilizing both left-to-right and right-to-left film cutters. Additionally, the right-to-left configuration allows new order finishing stations to be formed with an overall lengthwise reduction of approximately two feet. Given the great number of order finishing stations employed in commercial processing laboratories, this reduction in lengthwise dimension allows the addition of several more order finishing stations, thereby increasing the productivity for a given work area.

While a preferred embodiment of the present invention has been illustrated and described, it should be understood that variations could be made therein without departing from the scope of the invention. Accordingly, it is to be understood that the invention is not to be limited to the specific embodiment illustrated and described. Rather, the scope of the invention is to be determined by reference to the following claims.

The embodiments of the invention in which an exclusive property or privilege is claimed are defined as follows:

1. A film cutter assembly reversible between a right-to-left and a left-to-right film feed configuration, the film cutter assembly comprising:

a housing including multi-edged first and second end panels with each of said end panels having adjacent first and second resting edges and a film track edge not adjacent said resting edges, a base having contiguous first and second base plates sharing a longitudinal edge and orthogonally coupled at each end to said end panels at a location adjacent said resting edges, and a film track coupled at its ends to said end panels at a location adjacent said film track edges;

first and second control panels coupled at each end to said end panels of said housing at locations between said film track and said base plates on opposite sides of said film track, each of said control panels being selectively mountable to said housing adjacent either side of said film track, so that said first control panel is located above said film track and said second control panel is located below said film track regardless of which of said resting edges said housing rests on; and a reel assembly selectively mountable to said first end panel of said housing, so that said reel assembly is vertically oriented regardless of which of said resting edges said housing rests on.

2. The film cutter assembly of claim 1, wherein said film track edge of said end panels is substantially perpendicular to a line bisecting an included angle formed between said resting edges.

3. The film cutter assembly of claim 2, wherein said included angle is substantially 90 degrees.

4. The film cutter assembly of claim 1, wherein said end panels have five edges.

5. The film cutter assembly of claim 1, wherein said first control panel comprises a power switch, a machine function selection switch, and a machine status display.

6. The film cutter assembly of claim 1, further comprising:

film cutting means integral with said second end panel and disposed adjacent said film track; and a first film advancing means integral with said film track.

7. The film cutter assembly of claim 6, wherein said second control panel comprises switches for controlling said film cutting means and said first film advancing means.

8. The film cutter assembly of claim 6, wherein said reel assembly comprises:

a mounting plate having a first side and an opposite second side;

a reel spindle extending outwardly from said mounting plate for supporting a reel of photographic film, said reel spindle being reversibly mounted to said mounting plate so as to extend outwardly from either said first side or said second side of said mounting plate;

a second film advancing means extending outwardly from said mounting plate, said second film advancing means being reversibly mountable to said mounting plate so as to extend outwardly from either said first side or said second side of said mounting plate; and a protective cover coupled to the side of said mounting plate opposite that supporting the reel of photographic film.

* * * * *